US005184944A

United States Patent [19]

Scarfone

[11] Patent Number: 5,184,944

[45] Date of Patent: Feb. 9, 1993

[54] METHOD AND APPARATUS FOR CHANGING LUBRICATING OIL IN A ROTARY COMPRESSOR

[75] Inventor: Thomas F. Scarfone, E. Syracuse, N.Y.

[73] Assignee: Carrier Corporation, Syracuse, N.Y.

[21] Appl. No.: 612,640

[22] Filed: Nov. 13, 1990

[51] Int. Cl.[5] ..... F04B 17/00; F04B 35/04

[52] U.S. Cl. ..... 417/410; 417/902

[58] Field of Search ..... 417/410, 902; 184/6.16, 184/1.5, 109, 105.1, 105.3

[56] References Cited

U.S. PATENT DOCUMENTS

| | | | |
|---|---|---|---|
| 1,614,676 | 1/1927 | Kercher | 417/902 |
| 2,091,752 | 8/1937 | Davis | 417/902 |
| 3,922,114 | 11/1975 | Hamilton et al. | 184/6.16 |
| 4,640,669 | 2/1987 | Gannaway | 184/6.16 |
| 4,698,983 | 10/1987 | Hechavarria | 184/1.5 |
| 4,710,111 | 12/1987 | Kubo | 184/6.16 |
| 4,976,235 | 12/1990 | Commanday | 184/1.5 |

*Primary Examiner*—Richard A. Bertsch
*Assistant Examiner*—Alfred Basichas

[57] ABSTRACT

A rotary compressor having a sealed case containing a motor and a compressing device has a vertically extending rotor shaft that extends from the top of the case to the bottom. The bottom of the case forms a lubricating oil sump and the rotor shaft has a longitudinally extending through opening which defines a path from the sump to the upper end of the case. An access opening, having a removable plug therein, is provided in the upper end of the case in axial alignment with the opening in the rotor shaft. Removal of lubricating oil from the sump is accomplished by removing the removable access opening plug and inserting an oil extraction tube through the opening access opening and through the opening in the rotor shaft and in to the oil sump. A vacuum is applied to the end of the tube exterior of the compressor which withdraws the lubricating oil from the compressor sump.

3 Claims, 1 Drawing Sheet

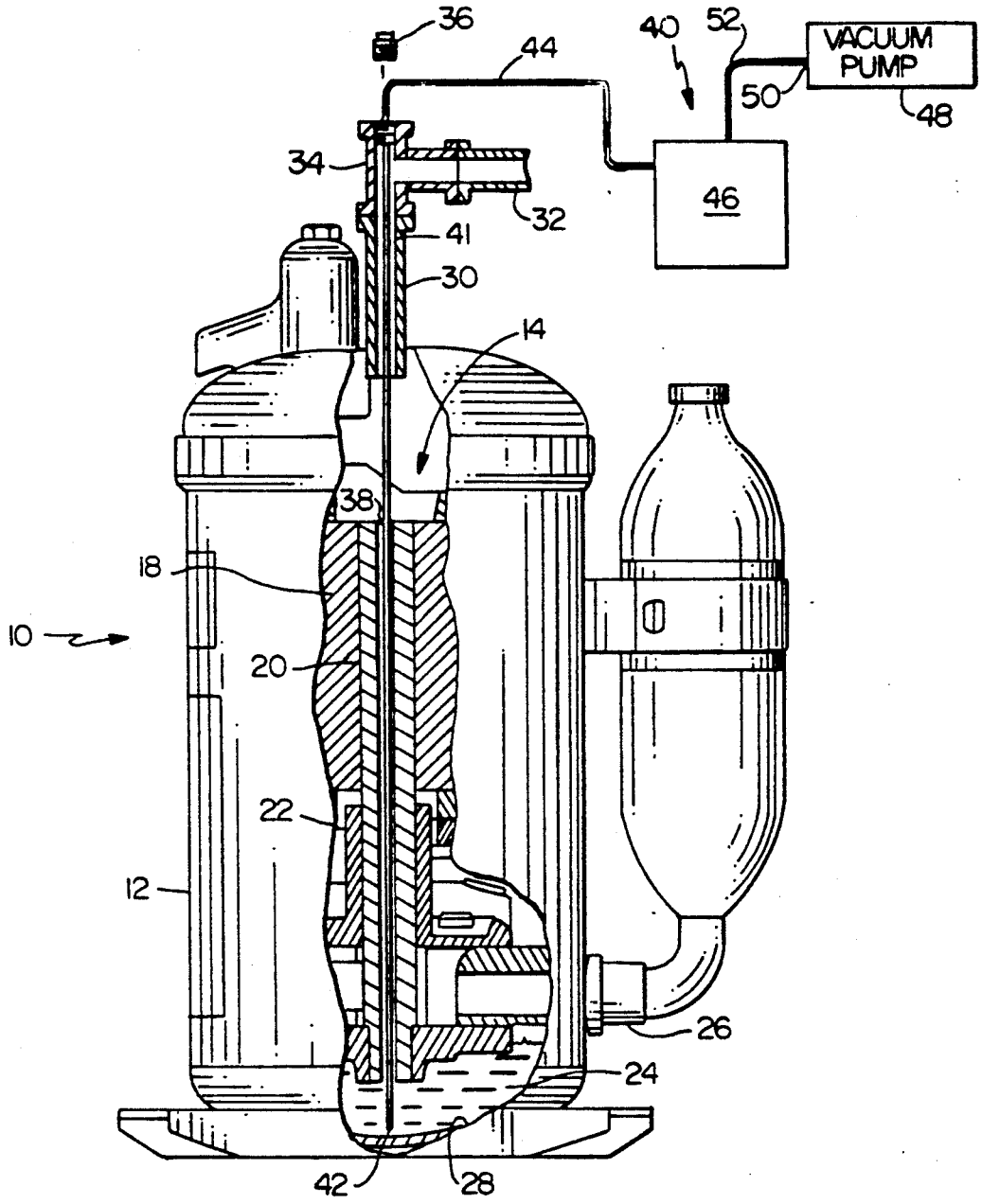
36
44
40
52
VACUUM PUMP
50
48
34
32
46
41
30
14
38
18
10
20
22
12
26
24
42
28

METHOD AND APPARATUS FOR CHANGING LUBRICATING OIL IN A ROTARY COMPRESSOR

BACKGROUND OF THE INVENTION

1. The Field of the Invention

This invention relates to rotary compressors for compressing refrigerant in refrigeration systems, and, more particularly to a method and apparatus for removing contaminated oil from such a compressor and replacing it with fresh oil.

2. Description of the Prior Art

In general, a rotary compressor is of a construction wherein a rotary compressing device and an electric motor for driving the compressing device are completely enclosed within a sealed case. The motor typically occupies the upper part of the case and the compressing device is located in the lower part. The lower part of the case forms a sump for lubricating oil used in lubricating the moving parts of the compressing device. A gaseous refrigerant to be compressed is supplied from the outside, compressed by the compressing device, sent upwards through the rotor and the motor air gaps and delivered from the case through a discharge port at the upper end.

One application for such compressors are systems designed for recovering and purifying contaminated refrigerant from a refrigeration system prior to service being performed on the system. In a typical system of this type the compressor is used to withdraw the contaminated refrigerant from the unit being serviced. Usually filters and other purification devices are used to remove contaminants and oil from the refrigerant being withdrawn prior to it passing to the recovery compressor. Regardless of the efficiency of the purification system, however, contaminants will reach the recovery compressor and, with time, contaminate the lubricating oil of the recovery compressor.

It is accordingly desirable to be able to remove the contaminated oil from the recovery compressor and to recharge the compressor with a fresh quantity of lubricating oil. One arrangement for accomplishing this has been to provide a threaded drain plug in the compressor oil sump. This can be messy, and quite often, because such systems are usually contained within a confined cabinet, access to an oil drain fitting may be difficult. Once the oil is drained, replacing the oil with fresh oil, typically requires use of a pump to pump a new oil charge into the compressor through the open drain fitting.

SUMMARY OF THE INVENTION

With the aim of solving the above described basic problem, the present invention seeks to provide a method and apparatus wherein the lubricating oil in a rotary compressor for refrigerants may be withdrawn and a fresh charge of oil returned to the compressor in a neat, simple, and efficient manner.

According to the invention a method and apparatus for changing the lubricating oil in a refrigeration compressor of the rotary type is provided. The compressor is of the type having a sealed case which includes an upper end and an oil sump in the lower end thereof. An electric motor is disposed in the upper part of the sealed case which has a vertical rotor shaft affixed thereto. A compressing device located in the lower part of the sealed case is driven by the vertical rotor shaft to compress refrigerant. The vertical shaft has a through opening which communicates the oil sump with the upper end of the sealed case. The sealed case has an opening in the upper end thereof in axial alignment with the through opening of the vertical motor shaft. A removable plug is contained within the axially aligned opening. Removal of lubricating oil is accomplished by removing the plug in the access opening and inserting a tube through the access opening and through the opening in the shaft. One end of the tube extends into the oil sump and the other end extends exterior of the compressor. A vacuum is applied to the end of the tube exterior of the compressor which serves to withdraw the lubricating oil from the compressor sump. The withdrawn oil is collected in a suitable container. Upon removal of all of the oil a fresh charge of lubricating oil is added to the compressor through the access opening and the opening is closed.

BRIEF DESCRIPTION OF THE DRAWINGS

The novel features that are considered characteristic of the invention are set forth with particularly in the appended claims. The invention itself, however, both as to its organization and its method of operation, together with additional objects and advantages thereof, will be best understood from the following description of the preferred embodiment when read in connection with the accompanying drawings wherein;

FIG. 1 is an elevation, in partial vertical section, showing an example of a rotary compressor embodying the present invention.

DESCRIPTION OF THE PREFERRED EMBODIMENT

In the accompanying drawing, there is shown a hermetic rotary compressor 10 the operational parts of the compressor are enclosed within a sealed outer case 12. In the upper part of the case 12 is disposed an electric motor 14 which includes a stator 16, a rotor 18, and, a vertical rotor shaft 20 integrally and coaxially fixed to the rotor 18. A suitable bearing structure 22 rotatably supports the rotor shaft 20 at its lower end. Below the bearing structure 22 is provided a rotary compressor device 24 coupled to and driven by the rotor shaft 20 and connected to a refrigerant suction fitting 26.

The lower end of the casing 12 defines a lubricating oil sump underlying the compressor device 24. The level of the lubricating oil, when the device is at rest, is substantially as shown in the drawing. At the upper end of the casing 12 a refrigerant discharge fitting 30 is centrally located in the top of the casing. The discharge fitting communicates with a compressor discharge line 32 forming a part of the refrigeration system in which the compressor is installed. Extending from the intersection of the discharge fitting 30 and the discharge line 32 is a vertically extending access opening 34 which is in axial alignment with the discharge fitting 30 and is provided with a removable plug 36.

The vertical rotor shaft 20 is provided with an opening 38 there through which extends from its upper most end adjacent the top of the casing to its lower most end in the oil sump 28. The opening 38 is shown in simplified form in the drawings however, its primary function is to serve as a part of the lubricating system of the compressor and it contains a number of oil passages therethrough which facilitate distribution of the oil to the mechanisms of the compressor requiring lubrication. As is evident from the drawing figure the centrally located discharge fitting 30 and access fitting 34 are in axial alignment with the opening 38 in the shaft 20.

The mechanism for withdrawing refrigerant oil from the compressor 10 is generally designated by reference numeral 40 in the drawing figure. The mechanism comprises a thin length of tubing 41 which is of a size that will pass through the access fitting 34, through the discharge fitting 30 of the compressor, and into the upper end of the compressor. It then passes through the opening 38 in the rotor shaft 20 downwardly where its lower end 42 terminates at the bottom of the oil sump 28.

The upper end 44 of the oil withdrawal tube 40 extends from the access fitting 34 and is sealingly connected at the upper end of a closed oil collecting container 46. A vacuum pump 48 has its suction port 50 connected via a suction line 52 to the closed oil collecting container 46.

Upon insertion of the oil withdrawal tube 41 into the compressor, as shown and described, actuation of the vacuum pump 48 results in a partial vacuum being created within the oil collecting container 46, which, in turn, applies the vacuum to the end of the oil withdrawal tube 41 thus resulting in the withdrawal of the lubricating oil from the compressor sump 28.

The oil withdrawn in this matter is collected within the oil collecting container 46 in which it is suitably contained. The container 46 may be readily disconnected from the vacuum pump 48 and the oil withdrawal tube 41 for disposal of the withdrawn oil in an environmentally acceptable manner.

Following withdrawal of the oil from the compressor sump 28 the oil withdrawal tube 41 is removed from the compressor 10 and a suitable quantity of fresh oil added to the compressor through the access opening 34. Reinstallation of the plug 36 within the access fitting 34 returns the compressor, with the fresh charge of oil contained therein, to condition for continued operation.

This invention may be practiced or embodied in still other ways without departing from the spirit or central character thereof. The preferred embodiment described herein is therefore illustrative and not restricted. The scope of the invention being indicated by the appended claims and all variations which come within the meaning of the claims are intended to be embraced therein.

What is claimed:

1. A Method of changing lubricating oil in a refrigeration compressor of the rotary type wherein the compressor has a casing having an upper end and an oil sump containing lubricating oil at the lower end thereof, a drive shaft having an opening there through communicating the oil sump of the compressor with the upper end of the casing;

the method comprising:

providing an openable and closeable access opening in the upper end of the casing in axial alignment with the opening in the shaft;

opening the access opening;

inserting a tube into the access opening and through the opening in the shaft, one end of the tube extending into the oil sump and the other end extending exterior of the compressor to thereby establish a fluid path between the sump and the exterior of the compressor;

applying a partial vacuum to the other end of the tube which is exterior of the compressor, the vacuum being sufficient to withdraw the lubricating oil from the compressor sump;

collecting the oil withdrawn from the compressor sump through the tube;

removing the partial vacuum to the other end of the tube when substantially all of the oil has been removed from the compressor sump;

adding a fresh charge of lubricating oil to the compressor through the access opening; and closing the access opening.

2. The method of claim 1 wherein said step of applying a partial vacuum includes the step of communicating the other end of the tube with a closed oil collection container; and applying the partial vacuum to the interior of the oil collection container.

3. A rotary compressor for a refrigerant comprising;

a sealed case defining an upper end;

an oil sump disposed in the lower part of said sealed case;

an electric motor disposed in the upper part of said sealed case, said motor having a vertical rotor shaft affixed thereto;

a compressing device disposed in the lower part of said sealed case, said compressing device being driven by said rotor shaft to compress refrigerant,;

said vertical rotor shaft having a through opening communicating the oil sump with the upper end of said sealed case;

said case having an opening in the upper end thereof in axial alignment with said through opening in said vertical rotor shaft; and removable plug means contained within said axially aligned opening.

* * * * *